US006301811B1

(12) United States Patent
Gilmore, Jr.

(10) Patent No.: US 6,301,811 B1
(45) Date of Patent: Oct. 16, 2001

(54) COUPLER FOR A HEAVY-DUTY MACHINE

(75) Inventor: Charles P. Gilmore, Jr., St. Joseph, MO (US)

(73) Assignee: Gilmore Industries, Inc., St. Joseph, MO (US)

( * ) Notice: Subject to any disclaimer, the term of this patent is extended or adjusted under 35 U.S.C. 154(b) by 0 days.

(21) Appl. No.: 09/627,339

(22) Filed: Jul. 28, 2000

(51) Int. Cl.[7] ..... E02F 3/96
(52) U.S. Cl. ..... 37/468; 414/723
(58) Field of Search ..... 37/443, 466, 468, 37/231, 403–407; 172/272–275; 403/14, 43, 45, 339, 340, 364; 414/694, 722, 723, 727

(56) References Cited

U.S. PATENT DOCUMENTS 5,360,313 11/1994 Gilmore, Jr. et al. .
5,484,250 1/1996 Gilmore, Jr. et al. .
5,890,871 4/1999 Woerman .
5,915,837 6/1999 Brown et al. .
6,042,295 3/2000 Barden .

*Primary Examiner*—Robert E. Pezzuto
(74) *Attorney, Agent, or Firm*—Lloyd L. Zickert

(57) ABSTRACT

A locking mechanism for a quick-connect/disconnect coupling for a heavy-duty machine including a boom and a stick to facilitate the interexchangeability of work tools wherein the locking mechanism can be remotely controlled to lock and unlock the coupling members when they are in mating engagement. The coupling includes a male member attachable to the boom of the machine and a female member attachable to the stick. The locking mechanism includes a pair of planetary gear assemblies, a motor and a brake that drive and maintain a pair of wedge shaped bars within their respective sockets. The coupling also includes proximity sensors to facilitate the proper engagement of the coupling members.

44 Claims, 9 Drawing Sheets

COUPLER FOR A HEAVY-DUTY MACHINE

DESCRIPTION

This invention relates in general to a coupler for a heavy-duty machine to enable the quick coupling and decoupling between a boom on the machine and a stick having a tool so that the machine may be easily used for sticks having different working tools, and more particularly to a coupler having a pair of coupling members having a series of sensors and a unique locking mechanism to firmly lock the coupling members together.

BACKGROUND OF THE INVENTION

Heretofore, it has been well known to provide a quick connect and disconnect coupling between the boom of a heavy duty machine and a stick, as described in U.S. Pat. Nos. 4,938,651, 5,108,252 and 5,484,250. These prior known coupling members include a female coupling member on the stick and a male coupling member attached to the boom. The female member includes a pin that may be engaged by either a grabber or a picker on the male coupling member to initiate engagement between the coupling members and allow the coupling members to be pivoted into mating interengagement. Additionally, the coupling members described in the above patents include locking means for locking the members together by articulated T-bars; threaded shafts and nuts; and wedge-shaped locking bars driven by a motor and gearbox assembly. These locking means are not always reliable during coupling and uncoupling operations.

SUMMARY OF THE INVENTION

The present invention is an improvement over the above referred to prior known couplers in that the locking mechanism for locking the two members together is unique and an improvement over the locking members of the prior known couplers. In particular, the locking mechanism includes a pair of planetary gear assemblies and a brake, in addition to the motor, to drive and securely lock the wedge-shaped locking bars on the male member in locked positions. The coupling members also include proximity sensors to indicate when to properly activate the locking mechanism and indicate when the coupling members are locked. Additionally, either or both the picker and grabber of the male coupling member includes a latch to prevent accidental and unwanted separation of the coupling members during the coupling and uncoupling process.

It is therefore an object of the present invention to provide a new and improved coupler for use between the boom of a heavy-duty machine and a stick with a tool which includes a unique locking mechanism that is provided with wedge-shaped locking bars and a brake to provide a wedge locking function between the members of the coupler.

A further object of the present invention is to provide a new and improved locking mechanism that utilizes planetary gears to drive wedge-shaped locking bars on a male coupling member into engagement with sockets on a female coupling member.

Another object of the present invention is to provide a new and improved locking mechanism that includes sensors to indicate when the coupling members are properly positioned to operate the locking mechanism and lock the coupling members together.

Still another object of the present invention is to provide latches on the picker and/or the grabber of the male coupling member to prevent the coupling members from accidentally separating during the coupling and uncoupling process.

Yet another object of the present invention is to provide latches on the picker and/or grabber of the male coupling member to maintain the pin of the female coupling member in place during the "coupling" process to assist in eliminating any excess play between the coupling members and any accidental premature disengagement.

A further object of the present invention is to provide sensors to indicate when the coupling members are properly locked or unlocked.

It is a further object of the present invention to use a roller pin to be engaged by the grabber or the picker to reduce the wear on the pin and the coupling members.

Yet another object of the present invention is to provide a stand for the stick to prevent the stick from falling over when the stick is laying on the ground.

Another object of the present invention is to provide a valve that diverts fluid from the high pressure line that goes to the stick to operate the motor.

Other objects, features and advantages of the invention will be apparent from the following detailed disclosure, taken in conjunction with the accompanying sheets of drawings, wherein like reference numerals refer to like parts

DESCRIPTION OF THE DRAWINGS

FIG. 13 is a longitudinal sectional view of the roller pin taken substantially along line 13—13 of FIG. 12;

DESCRIPTION OF THE INVENTION

Figure 1:
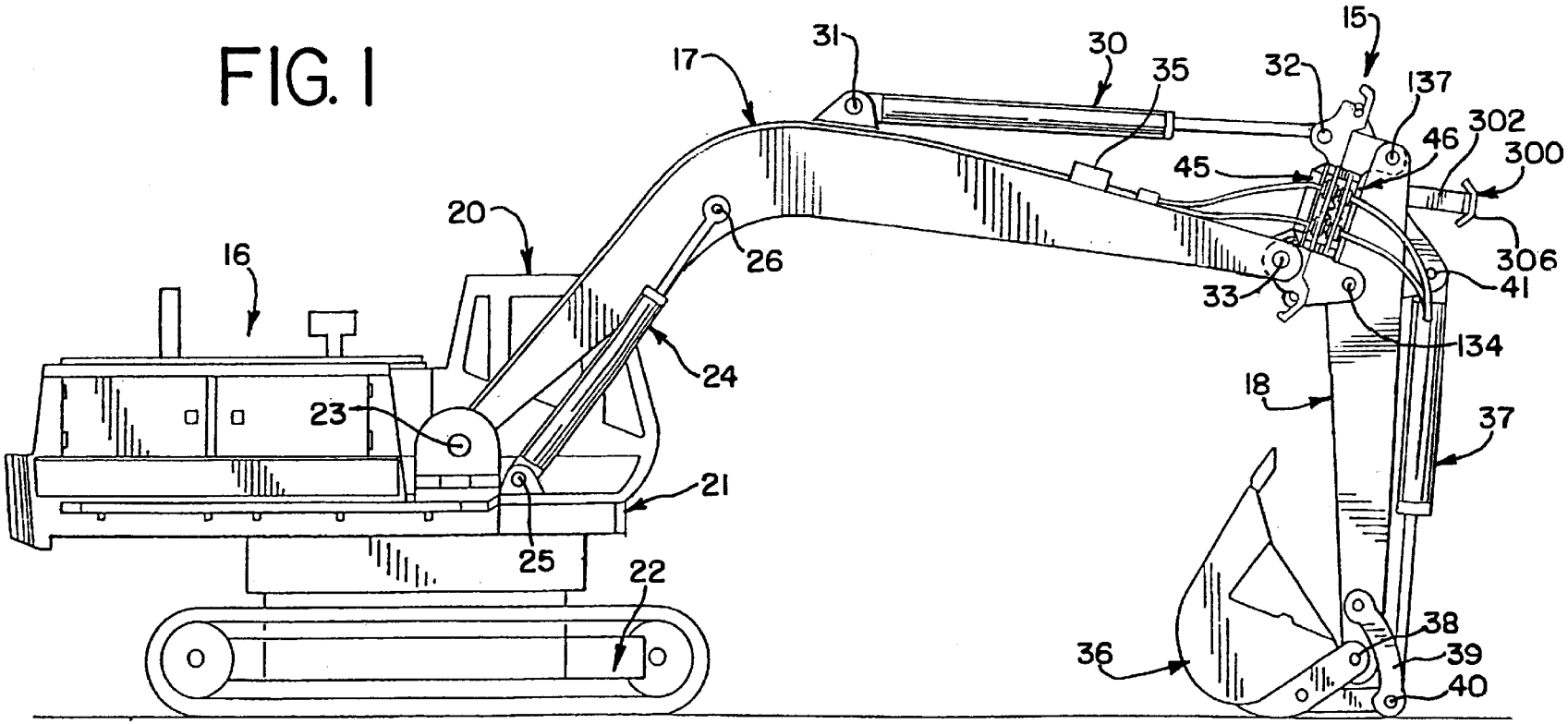
FIG. 1 is a side elevational view of a heavy-duty machine having a boom that is connected by the quick-disconnect coupling of the present invention to a stick having a tool.
Figure 2:
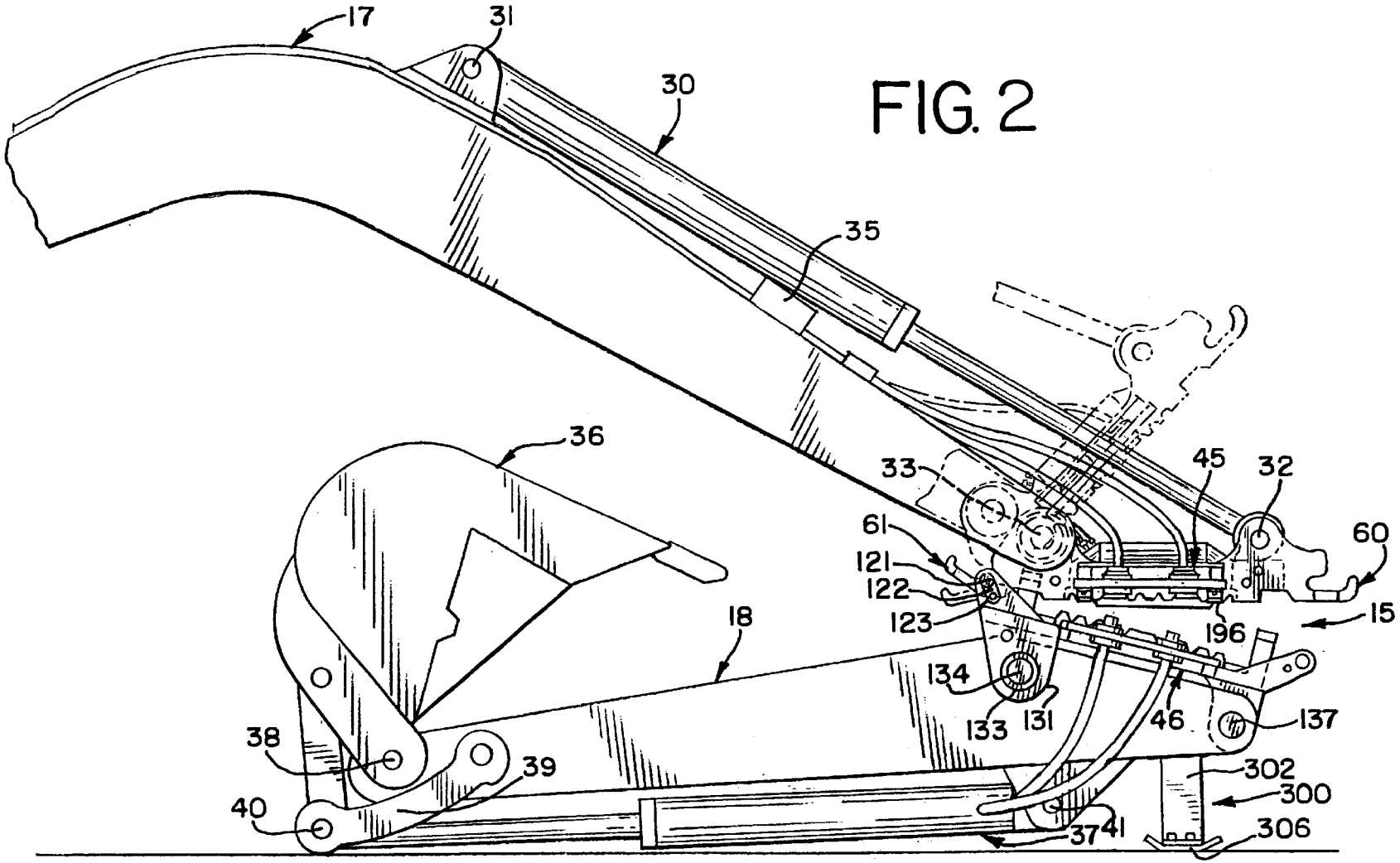
FIG. 2 is an enlarged side elevational view of the stick lying horizontally on the ground and being supported by a stand beneath a fragmentary side elevational view of the boom illustrating the manner in which the coupling members are brought together when the grabber of the male coupling member is used.

Referring now to the drawings, and particularly to FIGS. 1 to 7, the improved quick disconnect coupling of the present invention, generally designated by the numeral 15, is illustrated on a heavy-duty machine 16 having a boom 17 and a stick 18 connecting the stick to the boom, and which allows for the quick interchangeability of sticks having various tools or working members. The heavy-duty machine 16 includes a cab or operator station 20 on a carriage or base 21 which in turn is rotatably supported on a track drive 22. While the invention is shown on a heavy-duty machine having a boom and a stick, it is appreciated that the invention may also be used on other heavy-duty machinery such as farm equipment, an excavator, a back-hoe, or any other heavy-duty machinery where it is desired to have the capability of interexchanging tools.

The boom 17 is pivotally connected at one end to the machine at 23 and articulated in a vertical direction by means of a hydraulic cylinder 24 pivotally connected at one end at 25 to the machine base 21 and pivotally connected at the other end to the boom 17 at 26 in a known manner. Thus, operation of the hydraulic cylinder 24 swings the boom vertically up or down.

The boom 17 also includes on its upper side a stick cylinder 30 pivotally connected to the boom at one end at 31 and pivotally connected at the other end to the coupling 15 at 32. Thus, the coupling is pivotally connected to the end of the boom at 33.

The stick 18 includes a bucket 36 and a bucket-operating cylinder 37. The bucket is pivotally connected to the end of the stick 18 at 38 and includes linkage 39 which is pivotally connected to one end of the cylinder 37 at 40. The other end of the cylinder 37 is pivotally connected to the upper end of the stick 18 at 41. It will be understood that the coupling may be coupled while the stick is on the ground and underneath the boom, or while the stick is in the extended position on the ground. Moreover, because the coupling members are symmetrical such that either end may be aligned with each other, the stick may be mounted in an upside-down position.

For purposes of simplicity, not all of the various hydraulic lines are illustrated in the drawings for the hydraulic cylinders and for connecting the hydraulic power source generated by the machine. Further, it should be appreciated that while a stick and boom is shown with a hydraulic coupling, other types of couplings, such as suction, pneumatic or electric, can be used with the present invention. It should also be appreciated that while the stick 18 is shown as including a bucket as the working tool, other sticks having other working tools may be provided with female coupling members to be interchangeable so that the heavy-duty machine may serve to easily accomplish different working functions.

The coupling 15 preferably includes a male coupling member 45 connected to the boom 17 and a stick cylinder and a female coupling member 46 mountable on the stick 18. However, the female coupling member 46 may be connected to the boom 17 and the stick cylinder 30 and the male coupling member 45 may be mounted on the stick 18.

Figure 12:
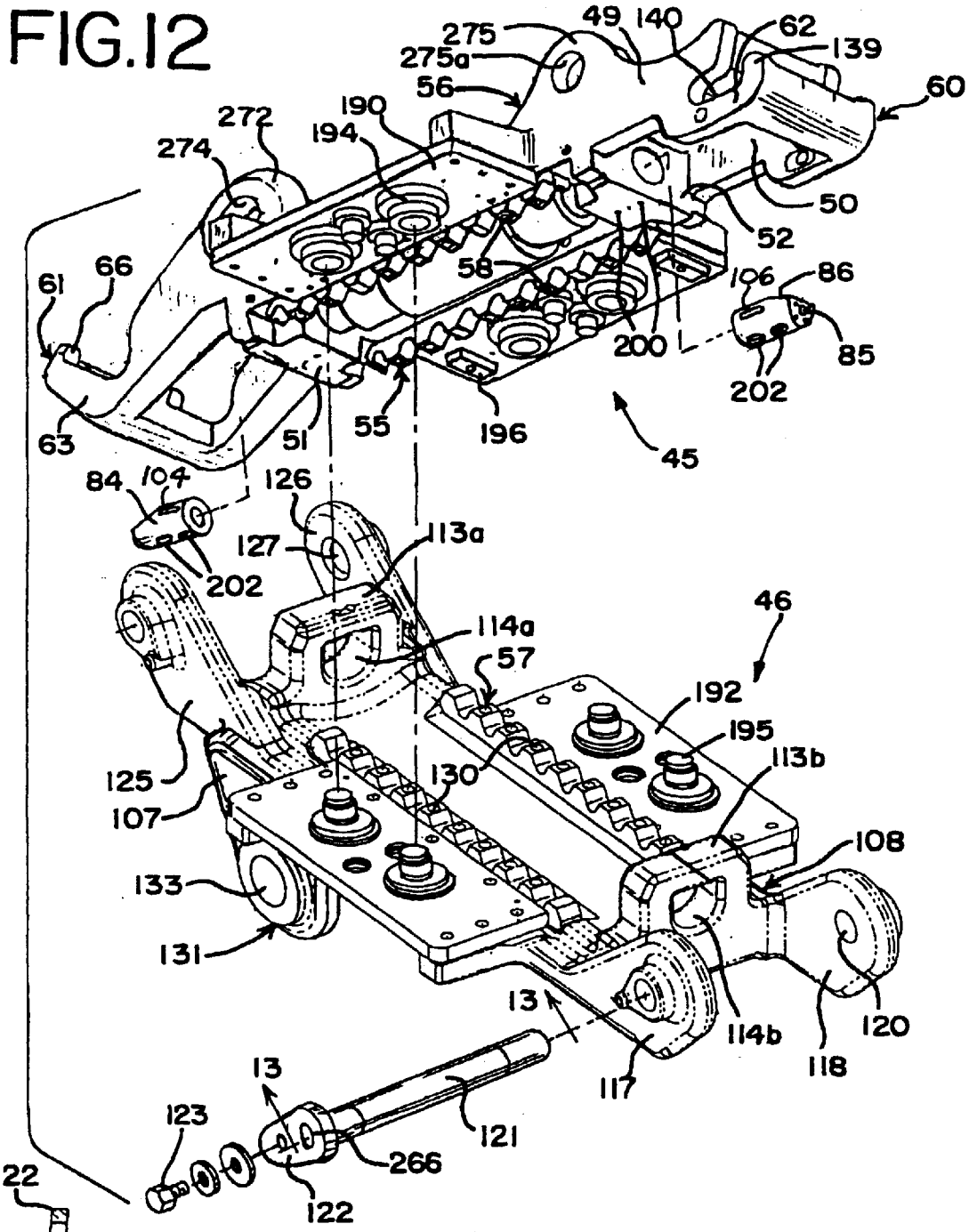
FIG. 12 is an exploded perspective view of the male and female coupling members showing the roller pin being placed in the female coupling member to be used with the picker of the male coupling member and not showing the latches on the picker and grabber of the male coupling member for purposes of clarity.
Figure 14:
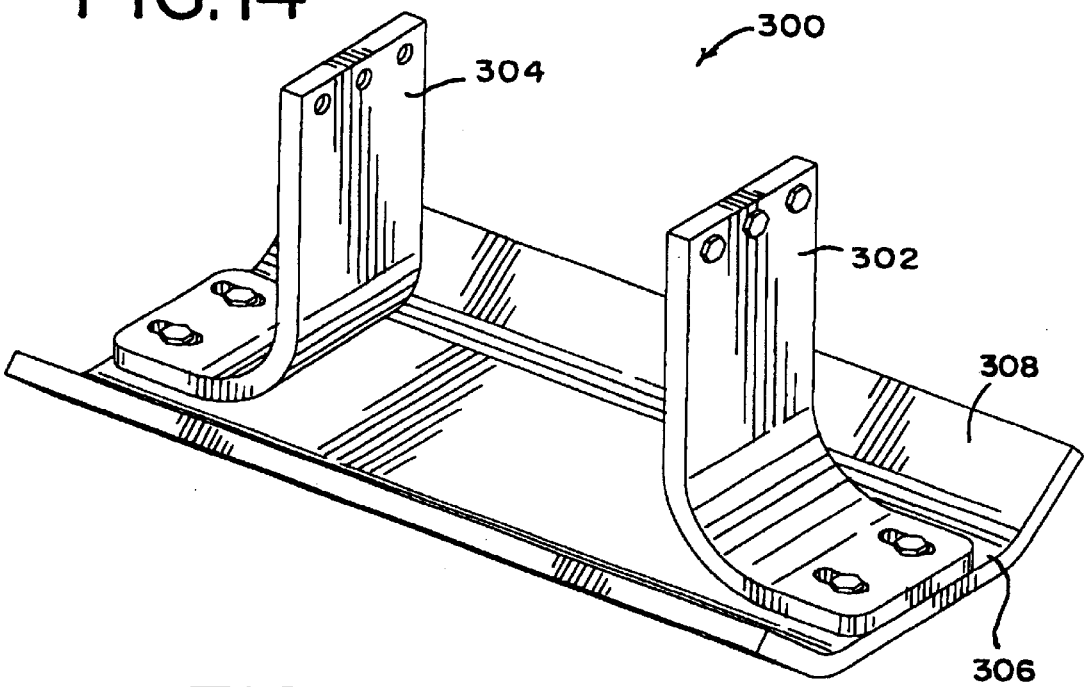
FIG. 14 is a perspective view of a stand that is attached to the stick to maintain the stick in an upright position when laying on the ground to prevent damage to the stick.

As particularly seen in FIG. 12, the female coupling member 46 includes two parallel and elongated side plates 107 and 108 that are spaced apart and interconnected at opposite ends by transversely extending end plates 109 and 110. At the opposite ends of end plates 109 and 110, teeth or tooth-shaped members 113*a* and 113*b* extend transversely to interengage in tooth sockets on the male coupling member formed by frame side plates 49 and 50 to control lateral movement between the coupling members. Further, these tooth-shaped members 113*a* and 113*b* include sockets 114*a* and 114*b* for slidably receiving and guiding the wedge-shaped bars 84 and 86 of the locking mechanism on the male coupling member.

At the top or head end of the female coupling member, arms 117 and 118 extend upwardly from and at an angle to the side plates 107 and 108 and are provided with aligned holes 120 for selectively receiving the pin 121 that coacts with the picker 60 during the initial guiding together of the male and female members during a coupling operation.

Figure 3:
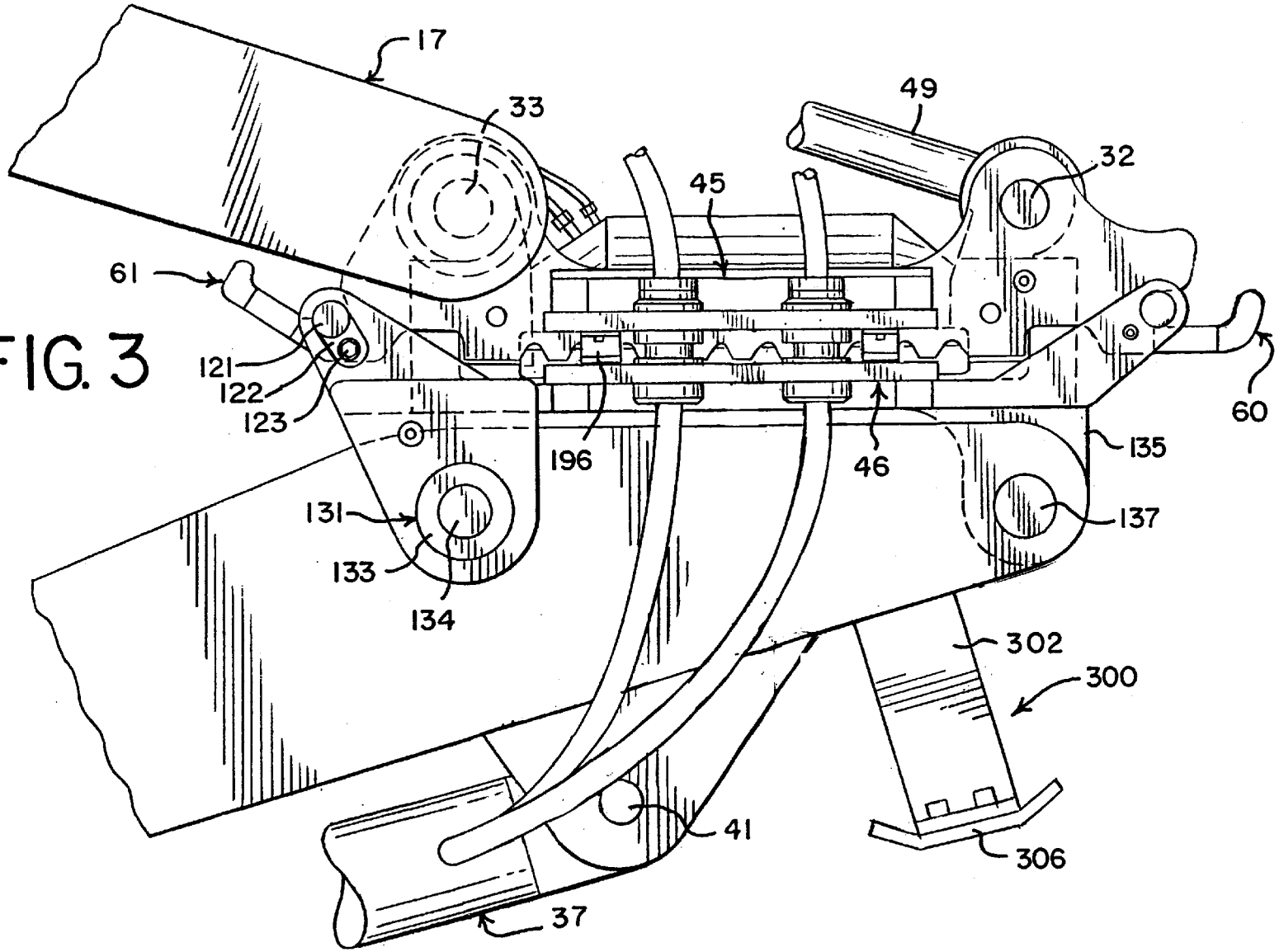
FIG. 3 is a fragmentary enlarged side elevational view of the coupling on the boom and the stick.

The pin 121 is preferably in the form of a roller pin and includes a retaining plate or lug 122 fixed at one end engaging the outside surface of the arm 117 and attachable to the arm by a bolt 123, as seen in FIG. 3. It is preferred that the pin is placed into the aligned holes of the arms such that the lug of the pin may be seen by the operator in the cab to indicate the location of the pin on the female coupling member. As seen in FIG. 13, the roller pin includes a roller pin cylinder 266 rotatably carried on a pin shaft 260 extending perpendicular to the lug 122. The roller pin cylinder is maintained on the pin shaft at one end by a shoulder 276 of the pin shaft 260 and at the other end by a cylindrical end cap 268 that is removably connected to the pin shaft by a cap screw 269. The outer surfaces of the pin shaft adjacent to the lug 122, the roller pin cylinder, and the end cap are contiguous. While the end cap 268 retains the cylinder on the shaft, sufficient tolerances are provided to allow the cylinder to rotate freely when the end cap is in place. The outer end of the end cap is beveled at 268*a* to facilitate the insertion of the pin into the aligned holes 120 of the coupling member. At opposite ends of the roller pin cylinder, annular notches are formed to receive annular seals 262 and 264 that coact with the pin shaft to seal against loss of lubricant injected between the roller pin cylinder and the pin shaft and against contaminants. Grease or lubricant is injected between the cylinder and shaft through a zerk or grease fitting 272 at the end of a passageway 270 that axially extends into the center of the pin shaft 260 and communicates through a radially extending hole 270*a* with a lubricating channel or grease groove 274 formed along a part of outer surface of the pin shaft.

In operation, grease or another lubricant is forced with a suitable grease gun through the grease fitting between the roller pin cylinder and the pin shaft to lubricate the pin and facilitate the rotation of the roller pin cylinder on the shaft. Use of the roller pin thus decreases the amount of wear on the pin and the male coupling member and facilitates the action of joining the coupling members during the coupling operation and separating the members during the decoupling operation.

Alternatively, if it is desired to utilize the grabber 61 to accomplish the initial alignment, the pin may be placed within the pin holes 127 of the extending arms 125 and 126 at the toe end of the female member. Thus, the pin 121 is interchangeably mountable at either end of the female member depending on whether the picker 60 or the grabber 61 is to be used during the coupling operation to bring the coupling members together. Within the confines of the female member side plates 107 and 108 and on the female member are two parallel rows of gear teeth 130 that mate with the gear teeth 58 of the male member during coupling of the members.

Figure 4:
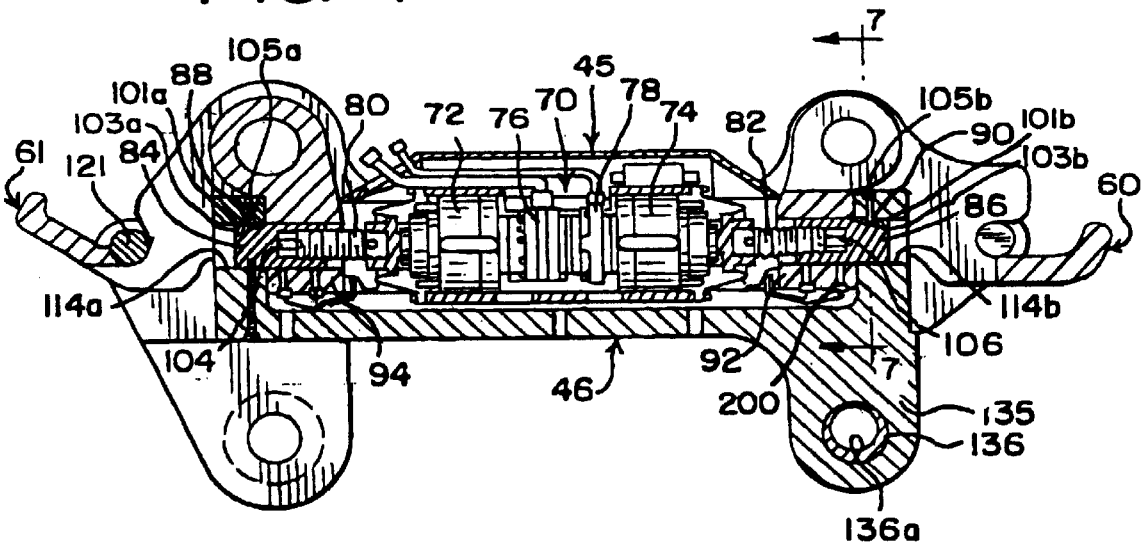
FIG. 4 is an enlarged longitudinal sectional view taken through engaging male and female coupling members and illustrating the locking mechanism of the present invention.

The female coupling member illustrated includes pin bosses for pin-connecting the female member to a stick having the standard pin holes. At the underside of the side plates 107 and 108 and the toe end of the female member, pin bosses 131 with aligned pin openings 133 are provided for pin-connection of the toe end of the female member to the stick by means of a pin 134 as seen particularly in FIGS. 1 to 3. At the head end of the female member, a single pin boss 135 is provided and centered so that it can fit between a bifurcated end of the stick. An eccentric bushing 136 having a pin hole 136*a* is received in the pin boss 135 as seen in FIG. 4 and may be adjustably rotated within its circular socket in order to compensate for minor spacing and/or misalignment differences that may occur in different sticks between the pin hole 136*a* and a pin 137 that is provided to pin-connect the pin boss 135 to the outer end of the stick.

It should be appreciated that the female member could be formed for direct welding or bolting to a stick. One way to weld the female coupling member to the stick would be to cut back part of the end of the stick and eliminate the pin bosses on the female coupling member such that the end of the stick and the underside of the female coupling member were substantially flat. The underside of the female coupling member may also have a wall shaped as a box to facilitate the welding process.

The male coupling member 45 includes a frame having a pair of parallel spaced-apart side plates 49 and 50 connected together near the opposite ends by end walls 51 and 52, as seen in FIG. 12. It will be appreciated that the entire coupling is made of a suitable steel and that the thickness of the plates and end walls is such that as a frame it will withstand all of the forces subjected to it during the use of the coupling by the heavy-duty machine. The side frame plates include a mating face 55 and a backside 56. Along the mating face of each of the frame plates 49 and 50 are a series of teeth 58. These teeth are preferably in the form of gear teeth and take the appearance of a rack gear at each side of the coupling member. The mating face 55 is adapted to mate with the mating face 57 of the female member 46.

At the toe end of the male member and also at the backside, pin bosses 272 are provided at each side plate for the purpose of providing a pin hole 274 that coacts with pin holes on the free end of the boom 17 to receive the pin 33 for pin-connecting the lower or toe end of the male member to the end of the boom so that the lower end of the male member can pivotally swing in a vertical direction relative to the end of the boom.

Also on the backside of the male member and at its upper or head end, pin bosses 275 are provided on the inner sides of plates 49 and 50 to define pin holes 275*a* for coacting with pin 32 to interconnect one end of the stick cylinder 30 to the upper or head end of the male member whereby actuation of the cylinder will cause pivotal swinging of the male member in a vertical plane.

The male coupling member includes at the upper or head end a picker 60 and at the lower or toe end a grabber 61, each of which may guidably assist in bringing together the coupling members during the coupling operation depending on which end is desired to be used and which end of the female member includes the pin 121.

Figure 8:
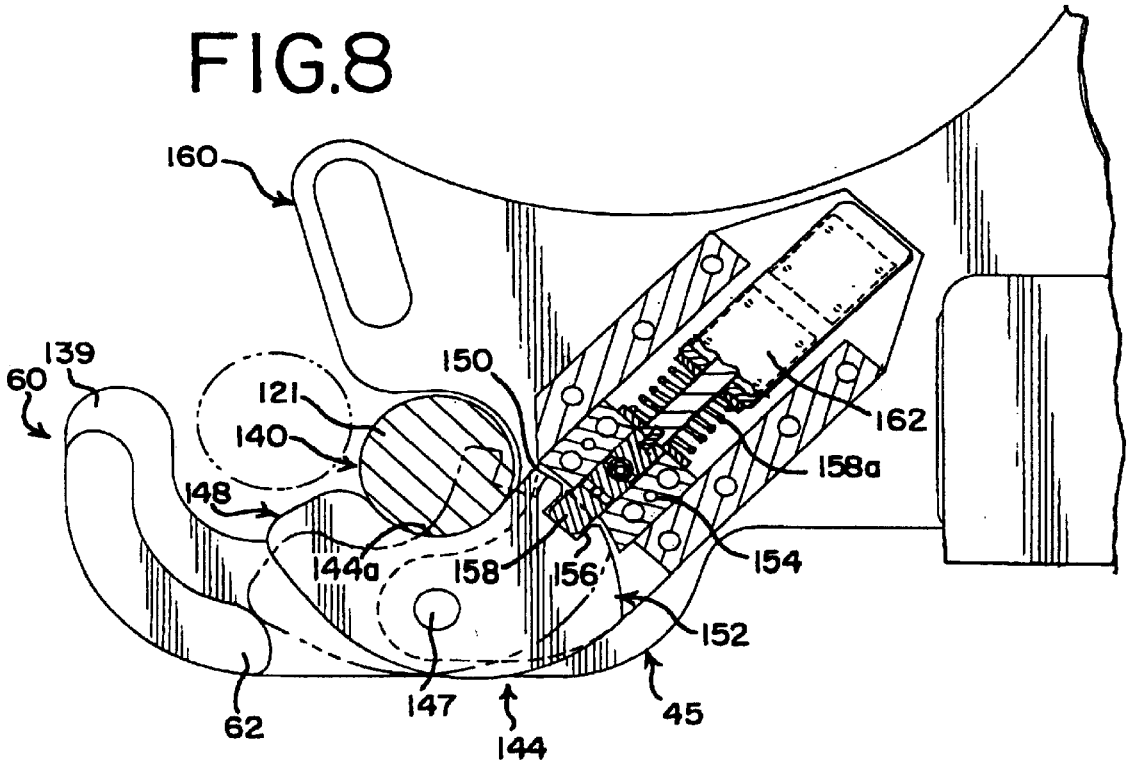
FIG. 8 is a fragmentary side elevational view of the picker of the male coupling member showing a latch mechanism for locking the pin of the female coupling member to the male coupling member with an outside plate removed to show underlying parts and showing the latch in solid in lock position and in phantom in unlock position.

The picker 60 includes a pair of parallel flat body sections or arms 62 interconnected at their ends that culminate in a hook 139 for facilitating the placement of the pin 121 within cavities or slots 140 when the coupling members are coupled. In order to maintain the pin within the cavities during the coupling and uncoupling of the coupling members, the picker preferably includes a latch 144 mounted on each arm adjacent to the cavities. The latch 144, which is shown on one of the arms of the picker in FIG. 8, is pivotally mounted on pin 147 extending from one side of the male coupling member 45 to a plate (not shown) mounted opposite the side of the male coupling member. The latch 144 includes an arcuately-shaped surface 144*a* such that the front section 148 and the back section 150 of the latch 144 may be engaged by the pin 121 of the female member when the pin is moved within the cavities of the picker.

The inner end 152 of the latch 144 includes a pocket or channel 156 for receiving a shot pin or locking pin 158. The locking pin 158, which is slidably received within opposed guides 154, is spring biased so that the locking pin 158 will be biased into the pocket or channel 156 when the channel is aligned with the pin. The inner end 152 of the latch 144 and the corresponding end of the guides 154 are arcuately-shaped to allow the latch 144 to freely rotate into and out of locked position. When the pin is not within the cavities of the picker, a torsion spring (not shown) around pin 147 rotates the latch in a counterclockwise direction and biases the back section 150 of the latch 144 upwards into the cavity 140 as shown in phantom in FIG. 8. While it is preferable to use a latch on each arm of the picker for additional safety, it is appreciated that one could also use only one latch and not depart from the teachings of the invention. It is also appreciated that a pair of latches may be contained in a latch assembly that fits inside the arms of the picker of the male coupling member.

The latching mechanism also has a proximity sensor 144*a* located on the outer plate that reads the location of the locking pin 158 to indicate when the latches are properly engaged with the pin in lock position. The sensor is mounted to sense when a divot formed on the side of the locking pin is aligned with the sensor. When the divot and the proximity sensor are aligned, a signal will be sent to the control panel 210 to turn on the "latched" light 222 and indicate that the pin is locked within the cavities of the picker end of the male member.

In operation, when the picker 60 on the male coupling member 45 is used to engage the pin 121 on the female coupling member 46 to begin the coupling process, the boom 17 is maneuvered such that the pin 121 abuts against the end wall 160 on the end of the coupling member 45. The boom may then be maneuvered to allow for the pin 121 to drop down into the cavity 140 of the picker 60. As the pin 121 enters the cavity 140, it will engage the back section 150 of the latch 144 and rotate the latch 144 until the channel 156 is aligned with the spring activated locking pin 158, which will automatically be driven into the channel 156 to lock the latch in place. The locking pin 158 is spring biased by a spring 158*a* into lock position and connected to a single acting hydraulic cylinder 162, and retractable into unlock position by actuation of the hydraulic cylinder following actuation of a solenoid actuable valve 144*b*. When the latch is locked or latched in place, the front section 148 of the latch 144 is located within the cavity 140 of the picker and in engagement with the pin to retain the pin 121 within the cavity 140 and latched to the picker end of the male coupling member. Additionally, the proximity sensor on the latching mechanism will send a signal to the control panel 210 to light up the latched light 222. Similarly, when the latching mechanism is unlatched, the unlatched light 224 will be actuated.

Figure 11:
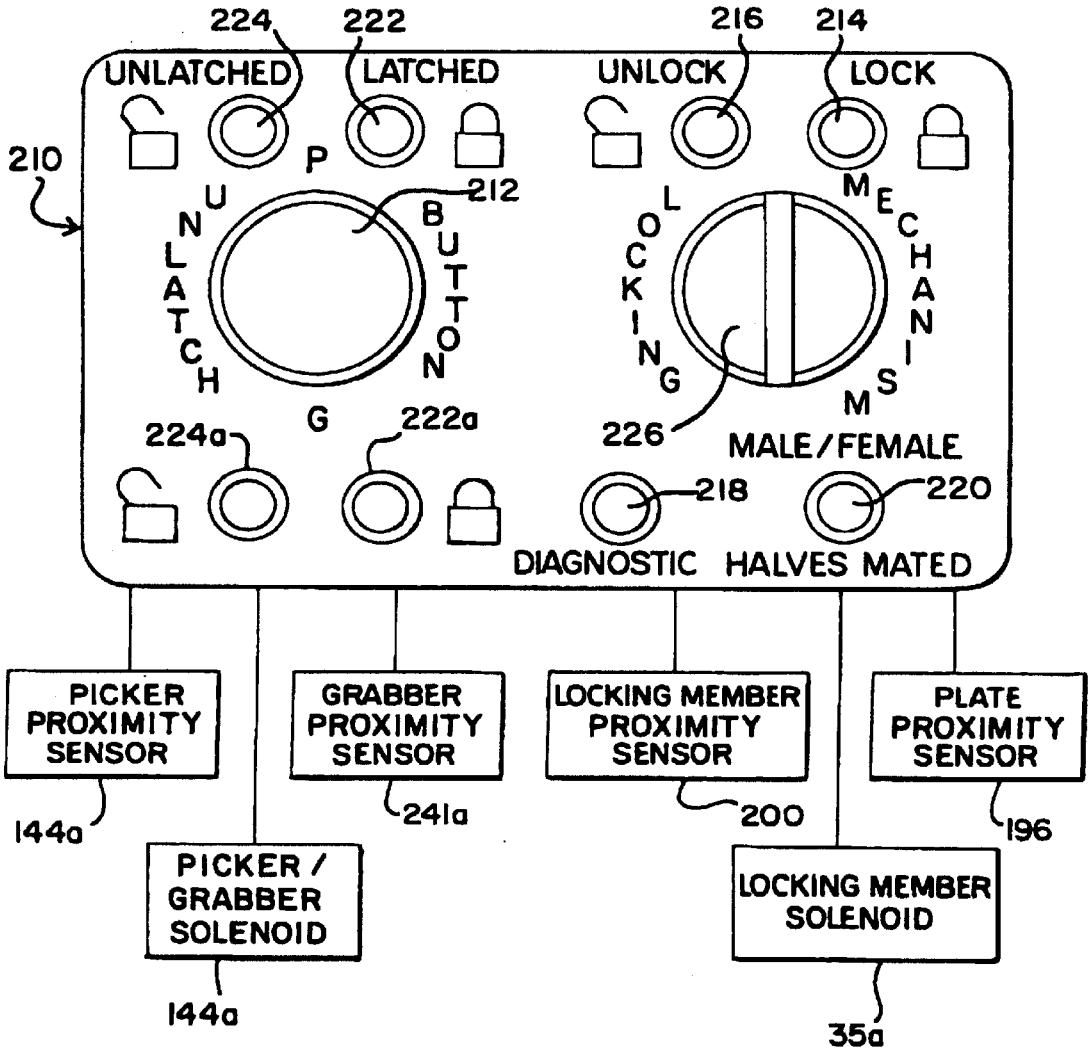
FIG. 11 is an elevational view of the control panel of the present invention showing in block form the various sensors and solenoids employed with the coupling members.

When it is desired to separate the coupling members, the solenoid actuated valve 144*b* suitably located on the coupler or the main chassis of the machine and controlled by depressing a button 212 on the control panel 210, as shown in FIG. 11, selectively feeds pressurized fluid to the hydraulic cylinder for actuating the latching mechanism to release the latch. The solenoid actuates the hydraulic cylinder 162 to retract the locking pin from the latch pocket and drive the spring biased latch to unlatch position and allow the latch to rotate as the female coupling member pin 121 is withdrawn from the picker cavities. As seen in FIG. 8, once the locking pin 158 is released, the pin 121 may be removed from the cavity 140 of the male coupling picker and the back section 150 of the latch 144 will once again be torsionally biased into the cavity. When the locking pin is retracted, the proximity sensor will no longer align with the divot and a signal will be sent to the control panel 210 to light up the unlatched light 224.

For safety reasons, it is preferred that the activation of the hydraulic cylinder to release the locking pin only operate for a short period of time such as ten (10) or twelve (12) seconds. If the pin of the female member has not exited the cavity of the picker in the designated time period, the hydraulic cylinder will be de-energize and the spring biased locking pin will move back into the channel to prevent rotation of the latch. The operator can thereafter repeat the uncoupling process if desired. Although the embodiment shown in FIG. 8 is spring-activated and hydraulically-released, it is appreciated that other suitable devices may be utilized to release the locking pin. The latch mechanism on the grabber 61 will operate in the same manner as on the picker 60.

Figure 10:
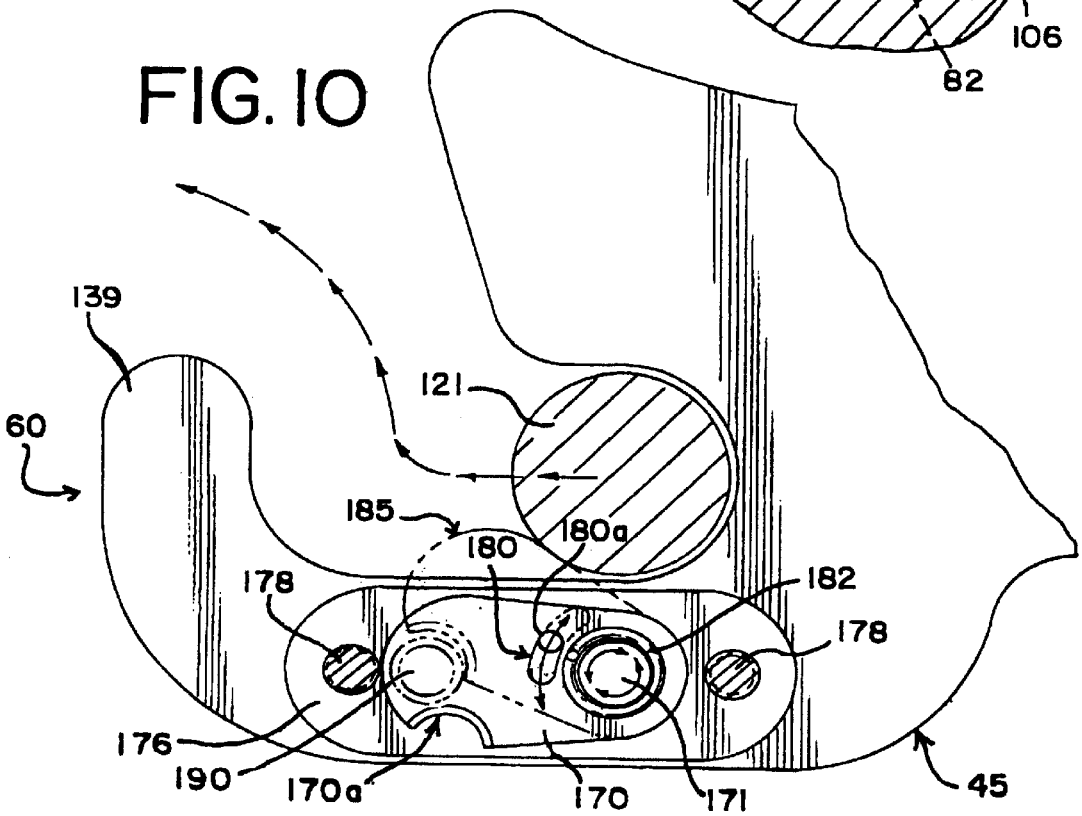
FIG. 10 is a fragmentary side elevational view of the picker of the male coupling member showing a modified latch mechanism showing the latch in solid in unlock position and in phantom in lock position.

An alternative latching mechanism is shown in FIG. 10 mounted on the picker 60 of the male coupling member. This mechanism includes a latch 170 pivotally mounted on a shaft 171 carried by a base plate 176 that is attached to one side of the male coupling member picker 60 through pins or other suitable attaching means 178. The latch 170 includes an arcuately-shaped slotted pin groove 180 receiving a fixed pin 180*a* that is designed to allow for the limited rotation of the latch 170. A torsion spring 182 normally rotates the latch 170 in a clockwise direction and biases the front end 185 of the latch upward into lock position. A retaining pin 190 is spring-activated to mate with the notch 170*a* to prevent the downward rotation of the latch in locked position. Once the latch is in lock position as shown in phantom, the pin 121 is prevented from escaping the picker of the male coupling member during the engagement of the coupling members, thereby preventing disengagement and decoupling of the coupling members. When it is desired to disengage the coupling members, the retaining pin 190 may be retracted through the use of a hydraulic actuator or other device to allow for the latch to rotate downward to allow retraction of the pin from the male coupling.

Figure 9:
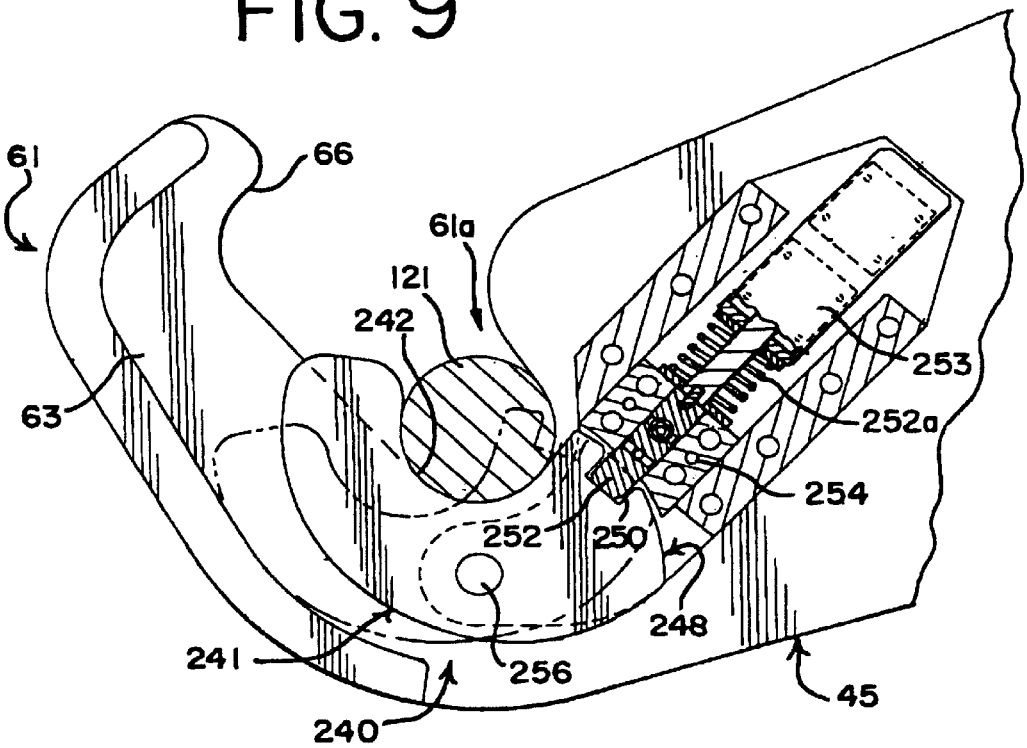
FIG. 9 is a fragmentary side elevational view of the grabber of the male coupling member showing the latch mechanism of FIG. 8 mounted on the grabber with the latch in solid in lock position and in phantom in unlock position.

The grabber 61 is mounted at the toe end of the male member to assist in guidably interconnecting the male and female members when the pin on the female member is located at the toe end of the female member. As seen in FIGS. 9 and 12, the end of the grabber 61 defines a pair of spaced apart slotted-shaped hooks 63 that receive the pin of the female member and position the respective ends of the coupling members so the intermeshing elements of each member may matingly engage. Additionally, the hook on the grabber may taper upwards to define a retaining wall 66 to maintain the pin within the grabber during engagement. Preferably, the height of the retaining wall is at least equal to the radius of the pin.

The grabber end 61 also preferably has a pair of latch mechanisms 240, as shown in FIG. 9, to retain the pin 121 within the slots 61*a* of the grabber end. The latch mechanism includes a hook-shaped latch 241 pivotally mounted on a shaft 256 between one side of the male coupling member 45 and a plate (not shown) parallel to the male coupling member 45. The latch 241 is arcuately-shaped to define a retention slot 242 that may be engaged by the female coupling member pin 121.

The latch 241 includes an inner end 248 having a socket 250 for receiving a shot pin or locking pin 252. The locking pin 252, which is slidably received in guides 254, is preferably spring-activated to be biased into the socket 250 when the socket aligns with the pin. When the pin is not within the grabber, a torsion spring (not shown) around shaft 256 applies a biasing force to the latch in a counterclockwise direction and to the position shown in phantom. It is preferred to have a latch mechanism on each arm of the grabber, although it is appreciated that the pin 121 of the female coupling member could be locked in place on the grabber by a single latch mechanism or by a latch assembly that includes a pair of latches.

The latch on the grabber of the male coupling member, which works the same as the latch shown in FIG. 8 for the picker of the male coupling member, includes a spring 252*a* that biases the locking pin 252 into engagement with the socket 250 of the latch and the solenoid 144*b* that actuates a single-action hydraulic cylinder 253 to release the locking pin from the socket. The latch also has a proximity sensor 241*a* located on the plate that coacts with a divot on the locking pin 252 to send a signal to the control panel 210 to indicate the position of the latch. When the divot and the proximity sensor are aligned, a signal will be sent to the control panel 210 to turn on the "latched" light 222*a* and indicate that the pin is contained within the cavities of the latch.

When the divot moves out of alignment with the proximity sensors, a signal will be sent to the control panel 210 to turn on the unlatched light 224*a* to indicate that the locking pin 252 is no longer within the socket 250 of the latch. Once the latch is released, the roller pin can exit the cavities to allow the coupling members to be uncoupled.

Figure 5:
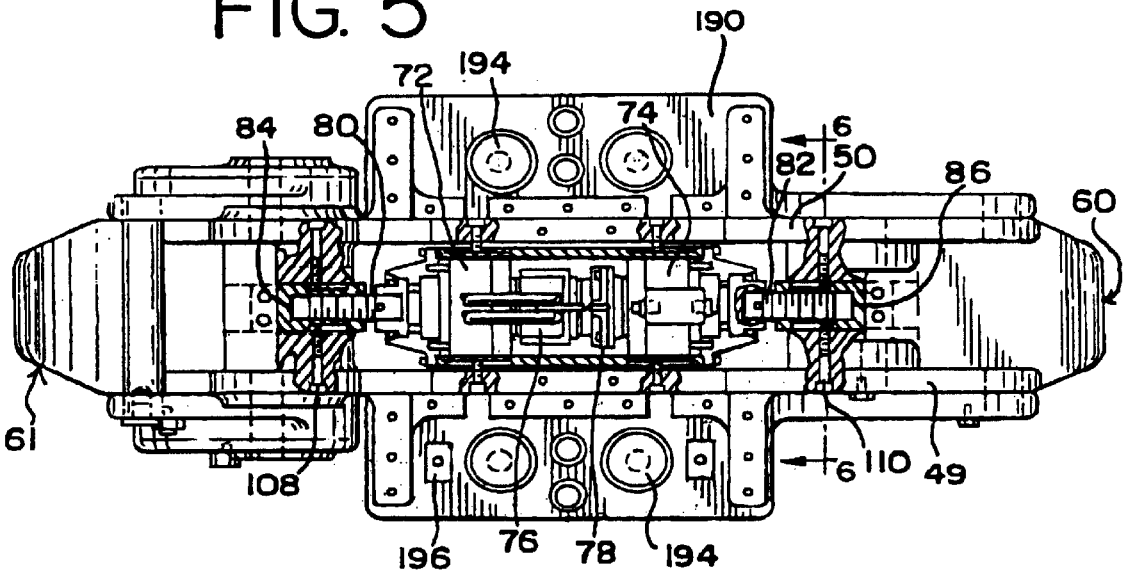
FIG. 5 is a bottom plan view of the male coupling member showing details of the locking mechanism and the support plates for the power coupling members and sensors.

As seen particularly in FIGS. 4 and 5, the male coupling member 45 includes a locking mechanism 70 to lock the coupling members 45 and 46. The locking mechanism 70 includes a pair of planetary gear assemblies 72 and 74, a motor 76 and a brake 78. The motor 76 is preferably hydraulic, but it could be electrical or any other suitable type if desired. The brake 78, which is preferably hydraulically actuated but may be otherwise actuated if desired, is connected to a shaft on one side of the motor 76. As seen particularly in FIGS. 4 and 5, the planetary gear assemblies 72 and 74, which are connected to and driven by the motor 76 have respectively pin connected thereto Acme threaded shafts 80 and 82, respectively. One of the threaded shafts has right-hand threads while the other threaded shaft has left-hand threads for respectively threadingly engaging and driving wedge-shaped locking bars 84 and 86 into lock and unlock positions. The locking bars may have a ball screw (not shown) in one end that may be filled part way with oil so that the engagement between the shaft and the locking bars are always adequately lubricated. Additionally, the ball screw may have a wiper seal (not shown) on the end to wipe the threads of the threaded shafts 80 and 82 when the shafts are withdrawn from the locking bars.

Figure 6:
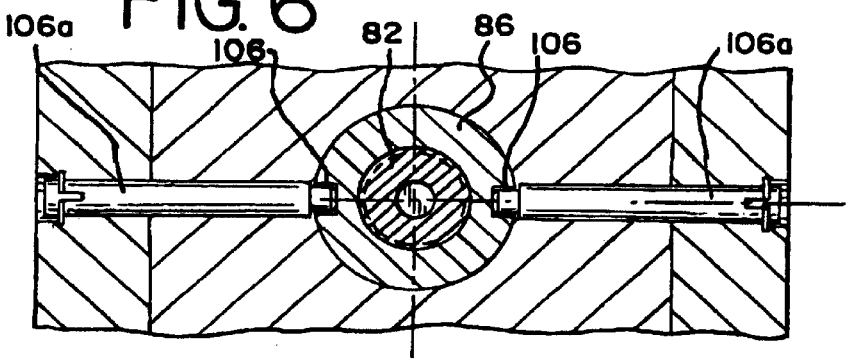
FIG. 6 is a fragmentary vertical sectional view taken substantially along line 6—6 of FIG. 5.
Figure 7:
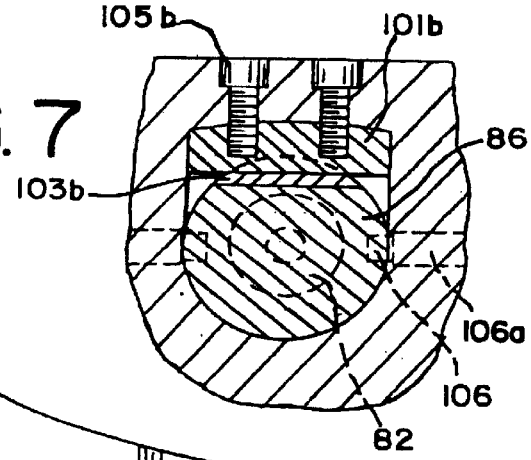
FIG. 7 is a fragmentary vertical sectional view taken substantially along line 7—7 of FIG. 4.

As shown in FIGS. 4 to 7, the locking bars 84 and 86 are generally cylindrical in shape and provided at their ends with wedge or slanted surfaces 88 and 90, respectfully, that ultimately coact with sockets 114*a* and 114*b* formed on the female member 46. Replaceable wear plates 101*a*, 101*b* and 103*a* and 103*b* are preferably provided in the sockets and on the wedge surfaces of the locking bars, respectively. The wear plates are preferably made of a wear-resistant material such as a steel having a hardness on the Shore "A" scale of 50–55. As shown in FIGS. 4 and 7, the socket wear plates 101*a* and 101*b* are attached to the sockets by capscrews 105*a* and 105*b*. Additionally, the wear plates 103*a* and 103*b* on the locking bars 84 and 86 are preferably rounded at the nose of the locking bars to limit the amount of wear. The locking bars 84 and 86 are respectfully slidably guided for reciprocal movement in the cylindrical bores of guide bushings or guideways 92 and 94. As shown in FIG. 12, the outer end of each of the locking bars has a series of threaded bores for attachment of a puller to allow the locking bars to be manually removed if the bars become stuck in their respective sockets after removal of the socket wear plates and disconnection of the Acme threaded shafts from the planetary gearing assembly output shaft. Further, a central hole 85 is provided for a zerk fitting to permit lubrication of the Acme threaded shaft.

In order to prevent the wedge-shaped locking bars 84 and 86 from rotating in the bushings 92 and 94, the locking bars are respectively provided with diametrically opposed, longitudinally extending keyway slots 104 and 106 at their outer surface that coact with pins or keys 104*a* and 106*a* mounted in the guide bushings. The pins are held in place by lock rings, as seen in FIG. 6. Additionally, the pins 104*a* and 106*a* coact with the slots 104 and 106 to retain the locking bars 84 and 86 in the bushings 92 and 94 and also to stop movement of the bars when one bar separates its socket prior to the other. The brake 78 serves to prohibit the movement of the bars 84 and 86 once the bars are in lock position by prohibiting the rotation of the threaded drive shafts 80 and 82. Thus, the brake serves to stop the bars from both being loosened from or driven further into their respective sockets.

The motor and planetary gear assemblies are slidably mounted on the male member so that if one of the wedge-shaped bars seats before the other, the motor and gear assemblies can slide or float and cause seating of the other wedge-shaped bar so that equal force is applied to both when they are in seated and locked position. Similarly, if one bar unseats or goes to unlock position before the other and is stopped by the pins/slots for that bar, the motor and gear assemblies will float or slide during retraction of the other bar.

As shown in FIGS. 4 and 12, the coupler includes a pair of proximity sensors 200 located on each of the end walls of the male member to detect whether the coupler members are properly locked together by the locking bars. The sensors 200 are spaced apart a distance that corresponds to the distance between a pair of divots 202 on the bottom side of the respective locking bar. The divots are preferably elongated so that they will still activate the proximity sensors if the wear plates on the locking bars and/or the sockets wear down such that the locking bars travel farther into their respective sockets. When all of the divots and the proximity sensors are aligned, a signal will be sent to the control panel 210 to turn on the "locked" light 214 and indicate that the coupling members are properly locked together. In order to help distinguish the "locked" and "unlocked" lights on the control panel, the lights may be of different colors, such as a green light 214 to indicate that the coupling members are locked together and a red light 216 to indicate that the coupling members are unlocked. Additionally, during both the locking and unlocking process, the lights 214 and 216 will flash to indicate that the locking bars are in between locked and unlocked position. It is also appreciated that a sound signal may accompany or take the place of the flashing lights to indicate when the locking mechanism is being operated.

If the "locked" light does not light up, the operator may check to see where the problem might exist by viewing the diagnostic light 218. The diagnostic light will indicate to the operator which locking bar is not properly aligned within its respective socket by the number of flashes, which may be set according to the preference of the operator or otherwise. The diagnostic light can also be used to indicate which locking bar is still locked within the socket when it is sought to unlock the coupling members. For example, one flash can indicate that the picker end is not unlocked, while two flashes can indicate that the grabber end is not unlocked. Similarly, three and four flashes can indicate that the picker end or the grabber end are locked, respectively. The response will depend on whether the operator is attempting to lock or unlock the coupler members.

Also, as particularly shown in FIGS. 5 and 12, plates 190 may be provided on the male member 45 and plates 192 may be provided on the female member 46 for purposes of receiving hydraulic fittings 194 and 195 where it is necessary to provide hydraulic power to a hydraulic cylinder on a stick. The plates, which extend perpendicular to the side plates of the coupling members include hydraulic fittings that align with the respective fittings on the other coupling member so that a hydraulic power connection may be established. While two hydraulic fittings 194 and 195 are shown per side, it is understood that one or more fittings may be utilized as needed, or other types of power couplings, such as suction or electric, may be utilized. The plates also are preferably fitted with proximity sensors 196 that are located on the coupling member on the boom side to provide for easy access to a power source (not shown); however, a portable power supply may be used if it is desired to have the sensors on the stick side coupling member. The proximity sensors 196 are connected to the control panel to actuate a light 220 on the control panel 210 to indicate when the plates 190 and 192 of the coupling member properly come together, thus indicating that the coupling members are properly engaged. While two proximity sensors are shown in FIG. 12, any number of proximity sensors may be used on the plate to indicate when the coupling members are properly mated. Furthermore, the plates may be designed to accommodate electrical, suction or pneumatic connections as well.

In operation, when the coupling members are properly mated, the proximity sensors 196 will send a signal to the control panel that will activate the "halves mated" light 220. Once the coupling members 45 and 46 are mated, a control knob 226 on the control panel in the cab 20 can be actuated to operate the motor 76 of the locking mechanism. When the locking mechanism is first activated, a locking member solenoid 35*a* sends a signal that instructs a ball valve 35, shown in FIG. 1, to cut off the flow of fluid to the high pressure line that operates the tool on the stick and redirect the fluid through another hydraulic line to operate the hydraulic motor and brake of the locking mechanism. As the locking mechanism does not require the same pressure and flow as the tools used with the stick, the ball valve also serves to reduce both the flow and pressure of the fluid. Specifically, the ball valve reduces the pressure from about 5,000 psi to between 1,000 and 1,500 psi and reduces the flow from about 92 gallons/minute to about 4 or 5 gallons/minute.

The motor 76 then drives the planetary gear units 72 and 74, which in turn drive the threaded shafts 80 and 82. The use of planetary gear units 72 and 74 generates the necessary torque in the locking mechanism 70 to drive the wedge bars between lock and unlock positions. The shafts will then drive the bars 84 and 86 into sockets 114*a* and 114*b*. When the divots 202 on each of the locking bars 86 are aligned with their respective proximity sensors 200, the "lock" light 214 on the control panel 210 will indicate that the locking bars are properly within the sockets to lock the coupling members together. If both bars are not properly within their respective sockets, a signal will be sent from the proximity sensors to the diagnostic light on the control panel to indicate which bar is not properly engaged. Once the bars are in lock position, brake 78 is actuated to lock the shafts against rotation, and thereby lock the locking bars in lock position. The brake is preferably spring activated and hydraulically released, and will prevent the rotation of the shafts 80 and 82. Once the bars are in lock position, the ball valve 35 will close the line to the locking mechanism and redirect the fluid back to the high pressure line of the stick.

When it is desired to change the stick and tool used by the machine, control 226 is actuated to hydraulically release the brake 78 and operate the motor 76 to retract the bars 84 and 86 from the sockets 114*a* and 114*b* so that the coupling members may begin the separation process while still being latched at the picker or the grabber of the male coupling member by retaining the pin of the female coupling member. The unlock light 216 on the control panel will light indicating to the operator the unlock condition of the locking mechanism. Similarly to when the locking mechanism is operated to lock the coupling members together, the controls also serve to send a signal to the ball valve to cut off flow to the high pressure line and redirect the fluid to the motor and the brake. After the locking bars on the male coupling member are retracted from their respective sockets on the female coupling member and the coupling members are rotational separated, the latches may be unlatched by actuation of the unlatch button 212 to allow for the pin to be released from the picker or the grabber and separate the boom from the stick. At this time, the unlatch light 224 or 224*a* will light, depending on whether the picker or grabber was latched.

In order to prevent any accidental damage to the stick or tool and/or its hydraulic cylinder when the stick is placed on the ground, the stick preferably includes a stand 300 as shown in FIGS. 1 to 3, and 14 located near the coupling member end of the stick. The stand 300 includes a pair of legs 302 and 304 that are suitably attached to the stick at one end and to a ground-engaging plate 306 at the other end. While the legs are shown being attached to the stick or the ground-engaging plate using bolts, it is appreciated that the legs may be attached by welding or other known methods. In order to accommodate sticks of different sizes, it is also appreciated that the spacing between the legs is adjustable by virtue of slots formed in the legs. To prevent damage to the stick cylinder and tipping of the stick, the legs should also be of sufficient weight to ensure that the stick cylinder is spaced above the ground. The ground-engaging plate may include angled ends 308 for providing better contact with the ground when the stick is raised from or lowered to the ground at an angle. It is also appreciated that while the stand is shown on a stick having a quick-disconnect coupling, it may be used on a stick not having a quick-disconnect coupling.

Figure 15:
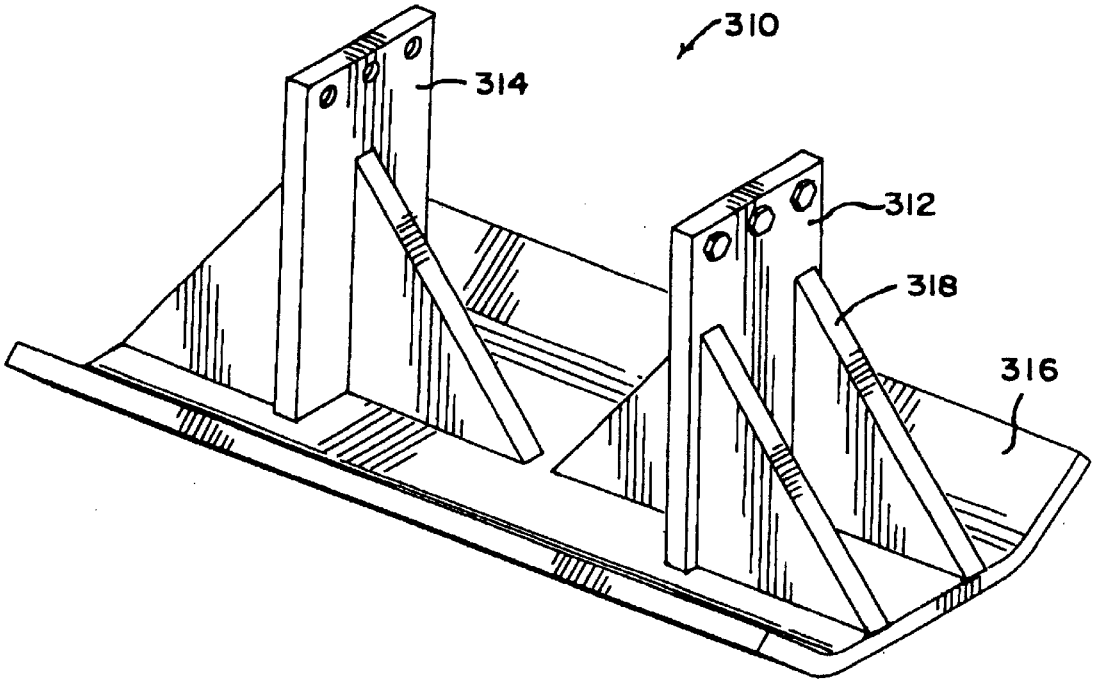
FIG. 15 is a perspective view of a modified stand of FIG. 14.

Another embodiment of a stand is shown in FIG. 15 and generally indicated by the numeral 310. Stand 310 includes legs 312 and 314 which are connected to a base 316. The legs are substantially straight and reinforced by a series of gussets or plates 318 to limit flexing of the legs. While a pair of legs is shown in the figures, it is appreciated that the stand may have one or more legs and not depart from the invention.

It will be understood that modifications and variations may be effected without departing from the scope of the novel concepts of the present invention, but it is understood that this application is limited only by the scope of the appended claims.

The invention is hereby claimed as follows:

1. A method of locking a stick to a boom in a heavy-duty machine wherein the machine includes a ground supporting base having an operator station, a boom pivotally mounted on one end to the base, a quick-connect/disconnect coupling for connecting the boom to a stick comprising a male coupling member pivotally connected to the boom and a female coupling member connected to the stick, the coupling members having locking means to lock and unlock the stick from the boom, the locking means including a pair of fixed sockets on the female coupling member, a pair of bars on the male coupling member movable longitudinally of the male coupling member and coacting with the mating sockets when the male and female coupling members are together, means reciprocally driving the bars in opposite directions between locking and unlocking positions and being slidably carried by the male coupling member for longitudinal movement thereon, and a brake to prevent movement of the bars and maintain the coupling in locked position, the method comprising the steps of:

pivotally connecting the stick to the boom such that the coupling members are engaged;

driving the locking bars into the sockets;

operating the brake to lock the stick coupler member to the boom coupling member.

2. The method of claim 1, which further includes the steps of sensing and indicating whether the male and female coupling members are properly engaged before driving the locking bars into the sockets.

3. The method of claim 1, which further includes the steps of sensing and indicating whether the locking bars are in place within the sockets.

4. The method of claim 3, which further includes the step of indicating, if necessary, which locking bar is not properly in place within the socket.

5. In a heavy-duty machine including a ground-supporting base having an operator station, a control panel inside the operator station, a boom pivotally mounted to one end of the base, a stick pivotally mounted to the free end of the boom, a working tool mounted on the free end of the stick, and a quick-disconnect coupling between the stick and the boom for facilitating the interchangeability of sticks having different tools comprising a male coupling member on the boom and a female coupling member on the stick, wherein the quick-disconnect coupling includes means for pivotally connecting the male coupling member to the female coupling member, the improvement in the coupling which comprises locking means operable from the operator station for locking the male and female members together in coupled relation and unlocking the male and female members to allow decoupling, the locking means including a pair of fixed sockets on the female member, a pair of wedge bars on the male member movable longitudinally of the male member and coacting with the mating sockets when the male and female members are together, means reciprocally driving the wedge bars in opposite directions between lock and unlock positions and being slidably carried by the male member for longitudinal movement thereon, and a brake on said driving means to prevent movement of the bars relative to the sockets once they are in locked position.

6. The machine of claim 5, wherein the driving means includes a hydraulic means for driving the bars into and out of engagement with the sockets.

7. The machine of claim 6, wherein the coupling includes a ball valve to operate the hydraulic means.

8. The machine of claim 7, wherein the coupling includes means to operate the ball valve.

9. The machine of claim 8, wherein the operating means includes a button on the control panel.

10. The machine of claim 5, wherein each bar of the locking means is guidably received in a guide bushing carried on the male member, means on each bar coacting with means on its respective bushing to prevent rotation of each bar in its respective bushing and serve as a stop to limit bar movement during uncoupling and to prevent each bar from coming out of the bushing.

11. The machine of claim 7, wherein the means on the bars includes longitudinally extending keyways or slots, and the means on the bushings includes pins extending into the keyways.

12. The machine of claim 5, wherein the driving means includes a pair of gear assemblies, a motor and a threaded shaft driven by the motor, the threaded shaft being threadedly received by the bars.

13. The machine of claim 12, wherein the motor is hydraulically powered.

14. The machine of claim 13, wherein the pair of gear assemblies are planetary gear assemblies.

15. The machine of claim 5, wherein the bars are wedge-shaped.

16. The machine of claim 15, wherein each of the bars includes a wear plate.

17. The machine of claim 16, wherein the wear plates are made of a wear-resistant material.

18. The machine of claim 17, wherein each of the sockets includes a wear plate.

19. The machine of claim 5, wherein the driving means includes an electromechanical means for driving the bar into and out of engagement with the socket.

20. The machine of claim 5, wherein the driving means includes a pneumatic means for driving the bar into and out of engagement with the socket.

21. The machine of claim 5, wherein the pivotally connecting means includes a grabber means on one end of the male coupling member, a picker means on the other end of the male coupling member, pin means interchangeably mounted on the female member for coacting with either the grabber means or the picker means, and latching means on the male member for locking the pin means to the male member during the coupling of the male and female member.

22. The machine of claim 21, wherein the latching means includes a latch normally biased into locking relation with said pin means, and a locking pin coacting with said latch to selectively lock the latch in lock position.

23. The machine of claim 22, wherein the locking pin is spring biased into lock position and hydraulically actuated into release position.

24. The machine of claim 23, wherein the latching means further includes means for sensing the locking pin in lock position.

25. The machine of claim 24, wherein the latching means further includes means responding to the sensing means for indicating the locking pin in locked position.

26. The machine of claim 5, wherein the locking means further includes means on each of the sockets for sensing when the wedge bars are in lock or unlock position.

27. The machine of claim 26 wherein the bar sensing means includes a pair of proximity sensors on each of the sockets and a pair of divots on each of the bars, wherein the proximity sensors are aligned with the divots when the bars are in lock position.

28. The machine of claim 27 wherein the divots are oblong in shape.

29. The machine of claim 27 which further includes means for indicating the bars are in lock or unlock position.

30. The machine of claim 29, wherein the bar indicating means includes a light on the control panel.

31. The machine in claim 5 which further includes means for sensing the correct mating of the coupling members.

32. The machine of claim 31, wherein the coupling sensing means includes a pair of proximity sensors.

33. The machine of claim 32, wherein the proximity sensors are mounted on the male coupling member.

34. The machine of claim 32 which further includes means for indicating the coupling members are correctly mated.

35. The machine of claim 34 wherein the coupling indicating means includes a light on the control panel.

36. In a heavy-duty machine including a ground-supporting base having an operator station, a control panel inside the operator station, a boom pivotally mounted to one end of the base, a stick pivotally mounted to the free end of the boom, a working tool mounted on the free end of the stick, and a quick-disconnect coupling between the stick and the boom for facilitating the interchangeability of sticks having different tools comprising a male coupling member on the boom and a female coupling member on the stick, wherein the quick-disconnect coupling includes means for pivotally connecting the male coupling member to the female coupling member, the improvement in the coupling which comprises locking means operable from the operator station for locking the male and female members together in coupled relation and unlocking the male and female members to allow decoupling, the locking means including a pair of fixed sockets on the female member, a pair of wedge bars on the male member movable longitudinally of the male member and coacting with the mating sockets when the male and female members are together, means reciprocally driving the wedge bars in opposite directions between locking and unlocking positions and being slidably carried by the male member for longitudinal movement thereon, and latching means on the male member for locking the pin means of the female member to the male member.

37. In a heavy-duty machine including a ground-supporting base having an operator station, a control panel inside the operator station, a boom pivotally mounted to one end of the base, a stick pivotally mounted to the free end of the boom, a working tool mounted on the free end of the stick, and a quick-disconnect coupling between the stick and the boom for facilitating the interchangeability of sticks having different tools comprising a male coupling member on the boom and a female coupling member on the stick, wherein the quick-disconnect coupling includes means for pivotally connecting the male coupling member to the female coupling member, the improvement in the coupling which comprises locking means operable from the operator station for locking the male and female members together in coupled relation and unlocking the male and female members to allow decoupling, the locking means including a pair of fixed sockets on the female member, a pair of wedge bars on the male member movable longitudinally of the male member and coacting with the mating sockets when the male and female members are together, means reciprocally driving the wedge bars in opposite directions between locking and unlocking positions and being slidably carried by the male member for longitudinal movement thereon, and means for sensing when the wedge bars are in lock position.

38. In a heavy-duty machine including a ground-supporting base having an operator station, a control panel inside the operator station, a boom pivotally mounted to one end of the base, a stick pivotally mounted to the free end of the boom, a working tool mounted on the free end of the stick, and a quick-disconnect coupling between the stick and the boom for facilitating the interchangeability of sticks having different tools comprising a male coupling member on the boom and a female coupling member on the stick, wherein the quick-disconnect coupling includes means for pivotally connecting the male coupling member to the female coupling member, the female coupling member being mounted on the end of the stick opposite to the working tool, means for supporting the coupling end of the stick above the ground when decoupled from the boom, said means comprising a stand mounted on the coupling end of the stick to elevate the female coupling member above the ground for facilitating coupling the stick to the male coupling member of the boom and for protecting the stick against damage.

39. The machine of claim 38, wherein the stand is mounted on the side of the stick opposite to the female coupling member.

40. The machine of claim 39, wherein the stand includes a ground-engaging plate, and arms extending therefrom and attached to the stick.

41. The machine of claim 40, wherein the arms of the stand are adjustable for sticks of different sizes.

42. The machine of claim 40, wherein the arms are rigidly connected to the ground-engaging plate, and gusset reinforcing members are connected between the plate and the arms.

43. In a heavy-duty machine including a ground-supporting base having an operator station, a control panel inside the operator station, a boom pivotally mounted to one end of the base, a stick pivotally mounted to the free end of the boom, a working tool mounted on the free end of the stick, and a quick-disconnect coupling between the stick and the boom for facilitating the interchangeability of sticks having different tools comprising a male coupling member on the boom and a female coupling member on the stick, wherein the quick-disconnect coupling includes means for pivotally connecting the male coupling member to the female coupling member, said pivotally connecting means including a grabber means on one end of the male coupling member, a picker means on the other end of the male coupling member, and pin means interchangeably mounted on either end of the female coupling member for coacting with either the grabber means or the picker means, the improvement being in the pin means which comprises: a pin shaft, a grease groove in the shaft, a roller pin extending over the grease groove and rotatably carried on the shaft, grease seals at opposite ends of the roller pin to maintain the grease on the shaft under the roller pin, a grease fitting at one end of the shaft communicating with the grease groove for providing grease to the pin means, and means for securing the pin means to the female coupling.

44. The machine of claim 43, wherein the pin shaft further includes a shoulder against which the roller pin abuts, and an end cap for securing the roller pin in place on the pin shaft but allowing free rotation of the roller pin on the shaft.

* * * * *